US006844789B2

(12) United States Patent
Lombardi et al.

(10) Patent No.: US 6,844,789 B2
(45) Date of Patent: Jan. 18, 2005

(54) LOW TEMPERATURE CO-FIRED CERAMIC (LTCC) CIRCULATOR

(75) Inventors: Robert B. Lombardi, Brockton, MA (US); Joseph S. Pleva, Londonderry, NH (US); Landon Rowland, Westford, MA (US); Paul Setzco, Wellesley, MA (US)

(73) Assignee: Raytheon Company, Waltham, MA (US)

( * ) Notice: Subject to any disclaimer, the term of this patent is extended or adjusted under 35 U.S.C. 154(b) by 71 days.

(21) Appl. No.: 10/234,672

(22) Filed: Sep. 4, 2002

(65) Prior Publication Data

US 2003/0090335 A1 May 15, 2003

Related U.S. Application Data

(60) Provisional application No. 60/350,565, filed on Nov. 13, 2001.

(51) Int. Cl.[7] ..... H01P 1/38
(52) U.S. Cl. ..... 333/1.1; 333/24.2
(58) Field of Search ..... 333/1.1, 24.2

(56) References Cited

U.S. PATENT DOCUMENTS

| | | | | | |
|---|---|---|---|---|---|
| 3,334,317 | A | * | 8/1967 | Andre | 333/1.1 |
| 5,028,473 | A | * | 7/1991 | Vitriol et al. | 428/137 |
| 5,159,294 | A | * | 10/1992 | Ishikawa et al. | 333/1.1 |
| 5,379,004 | A | | 1/1995 | Marusawa et al. | 333/1.1 |
| 5,532,667 | A | | 7/1996 | Haertling et al. | 336/177 |
| 5,709,811 | A | * | 1/1998 | Satoh et al. | 252/62.57 |
| 6,348,843 | B1 | * | 2/2002 | Furuya et al. | 333/1.1 |

OTHER PUBLICATIONS

PCT International Search Report (PCT/ISA/220) as issued for International Application No. PCT/US02/34981.

Takeda, Kishimoto, Itoh and Ichikawa, "Possibility of Ultra Fine Isolator for Portable Phone." 2001 IEEE *MTT–S Digest*. 0–27803–6538–0/01. XP–00167321: pp. 479–482.

Brown, Shapiro, Polinski: "The Integration of Passive Components Into MCMs Using Advnced Low–Temperature Cofired Ceramics:" *The International Journal of Microcircuits & Electronic Packaging*; vol. 16, No. 4, Fourth Quarter, 1993, (ISSN 1063–1674): The International Society for Hybrid Microelectronics, pp. 328–337.

Kniajer, Dechant and Apte: "Low Loss, Low Temperature Cofired Ceramics with Medium Dielectric Constants:" *The International Journal of Microcircuits and Electronic Packaging*, vol. 20, No. 3, Third Quarter 1997 (ISSN 1063–1674): International Microelectronics and Packaging Society: pp. 246–253.

Fay, C.E. and Comstock, R.I.: "Operation of the Ferrite Junction Circulator:" IEEE Transactions on Microwave Theory and Techniques: Jan. 1965; pp. 15–27.

Wu, Y.S. and Rosenbau, Fred J.: "Wide–Band Operation of Microstrip Circulators:" IEEE Transactions on Microwave Theory and Techniques, vol. MTT–22, No. 10, Oct. 1974: pp. 849–856.

* cited by examiner

*Primary Examiner*—Robert Pascal
*Assistant Examiner*—Stephen E. Jones
(74) *Attorney, Agent, or Firm*—Daly, Crowley & Mofford, LLP

(57) ABSTRACT

A radio frequency (RF) circulator includes a low temperature co-fired ceramic (LTCC) substrate and a ferrite structure disposed in the LTCC substrate. The circulator also includes first, second and third transmission lines disposed in the LTCC substrate and coupled between the ferrite disk and first, second and third ports of the circulator. The ferrite structure embedded in the LTCC substrate is exposed to an appropriate direct current (DC) magnetic field, to provide the circulator as an integrated LTCC substrate circulator.

30 Claims, 8 Drawing Sheets

LOW TEMPERATURE CO-FIRED CERAMIC (LTCC) CIRCULATOR

CROSS REFERENCE TO RELATED APPLICATIONS

This application claims the benefit of U.S. Provisional Application No. 60/350,565 filed Nov. 13, 2001 which application is hereby incorporated herein by reference in its entirety.

STATEMENT REGARDING FEDERALLY SPONSORED RESEARCH

Not Applicable.

FIELD OF THE INVENTION

This invention relates to radio frequency (RF) components and more particularly to circulators.

BACKGROUND OF THE INVENTION

As is known in the art, a radio frequency (RF) circulator is typically a three-port device, having a first, a second, and a third port. A conventional circulator provides a directional capability, directing an RF signal applied as input to the first port to provide an output signal at only the second port. Similarly, the circulator directs an RF signal applied as input to the second port to provide an output signal at only the third port, and an RF signal applied as input to the third port to provide an output signal at only the first port.

A conventional circulator operates at a particular RF frequency or over a range of frequencies within which the circulation has an insertion loss characteristic and an isolation characteristic. It is generally desirable for the circulator to have a wide bandwidth, a relatively low insertion loss characteristic, and a relatively high isolation characteristic (where the isolation value is given in positive units).

A conventional circulator is typically a discrete device that can be mounted to a circuit board. As a discrete device, the conventional circulator does not provide an optimal form factor for high density electronics packaging.

It would therefore be desirable to provide a circulator that can be more easily integrated into an RF circuit and that has a smaller size than a conventional circulator.

SUMMARY OF THE INVENTION

In accordance with the present invention, a circulator includes a low temperature co-fired ceramic (LTCC) substrate and a ferrite disk disposed in the LTCC substrate. The circulator can also include a first transmission line disposed in the LTCC substrate and coupled to a first port of the circulator, a second transmission line disposed in the LTCC substrate and coupled to a second port of the circulator, and a third transmission line disposed in the LTCC substrate and coupled to a third port of the circulator. The circulator also includes magnets that provide a DC magnetic field about the ferrite disk. In one embodiment, the LTCC substrate includes LTCC layers upon which circuit traces, vias, or circuit components can be disposed.

With this particular arrangement, the circulator is integrated into the LTCC substrate and thereby into an RF circuit also disposed on the LTCC substrate. Thus, the circulator of the present invention is provided having a form factor which is more compact than a conventional circulator. Thus, packaging density of RF circuits which include the circulator is improved.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
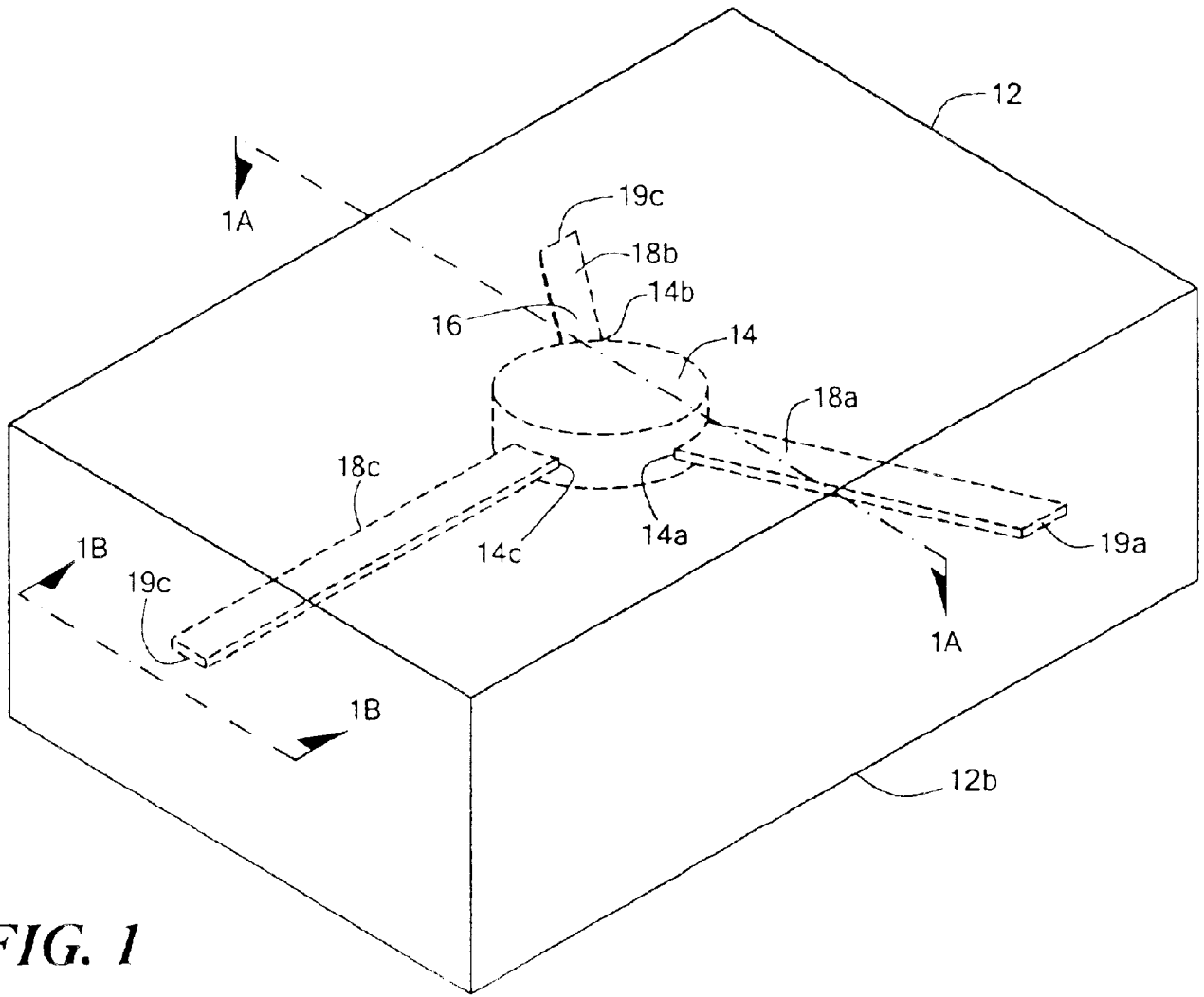
FIG. 1 is an isometric view of a portion of an exemplary circulator in accordance with the present invention.
Figure 1A:
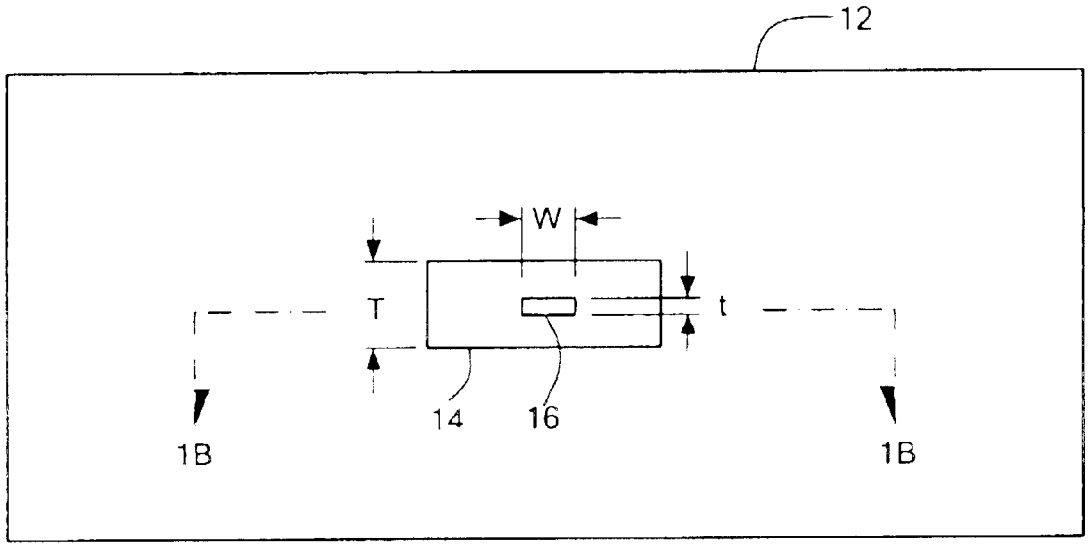
FIG. 1A is across-sectional view taken along lines 1A—1A of the portion of the circulator of FIG. 1.
Figure 1B:
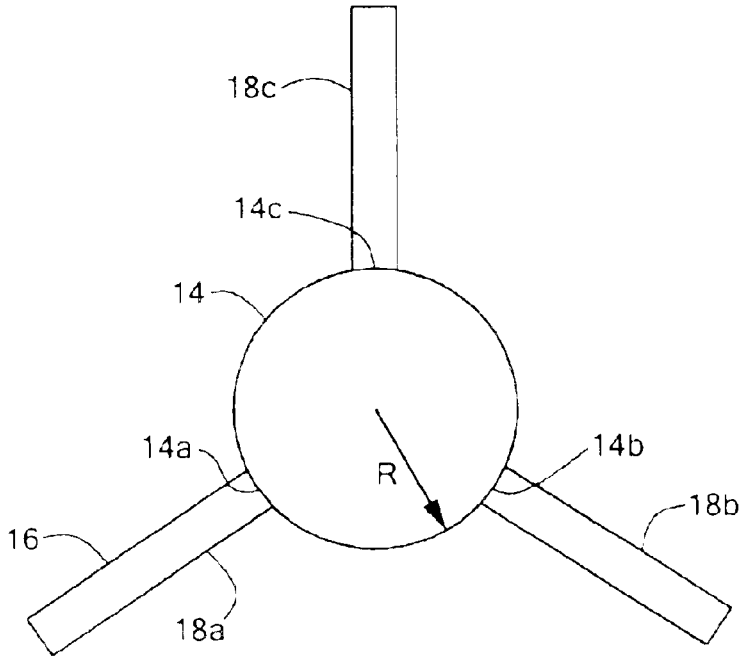
FIG. 1B is a cross-sectional view taken along lines 1B—1B of the portion of the circulator of FIG. 1.

Referring to FIGS. 1–1B, in which like elements are provided having like reference designations throughout the several views, an exemplary portion of a circulator 10 includes a single Low Temperature Co-fired Ceramic (LTCC) substrate 12 having a first or upper surface 12*a* and a second or lower surface 12*b*.

A ferrite structure 14 is embedded or otherwise provided in the LTCC substrate 12. The ferrite structure has a size and shape selected in accordance with a variety of factors. One particular technique for selecting the size, shape and other characteristics of the ferrite structure 14 will be described below in conjunction with FIGS. 6–7. The ferrite structure has a thickness, T, (FIG. 1A), and a radius, R, (FIG. 1B).

The ferrite structure 14 has three ports 14*a*–14*c* that correspond to circulator ports. Transmission lines 18*a*–18*c* each have a first end coupled to a first corresponding one of the ports 14*a*–14*c* and a respective second end 19*a*–19*c* adapted to couple to other circuit components or transmission lines of other circuits (none shown in FIGS. 1–1B). For example, a first one of the transmission lines 18*a*–18*c* can be coupled to an antenna or an antenna signal path, a second one of the transmission lines 18*a*–18*c* can be coupled to a transmitter or a transmitter circuit signal path, and a third one of the transmission lines 18*a*–18*c* can be coupled to a receiver or a receive circuit signal path. Other connections are also possible. Each of the three transmission lines 18*a*–18*c* consists of a conductive material having a thickness, t, (FIG. 1A), and a width, w, (FIG. 1B). The transmission lines 18*a*–18*c* thus have an impedance characteristic that provides an appropriate impedance match between the ports 14*a*–14*c* and other circuit components.

Figure 2:
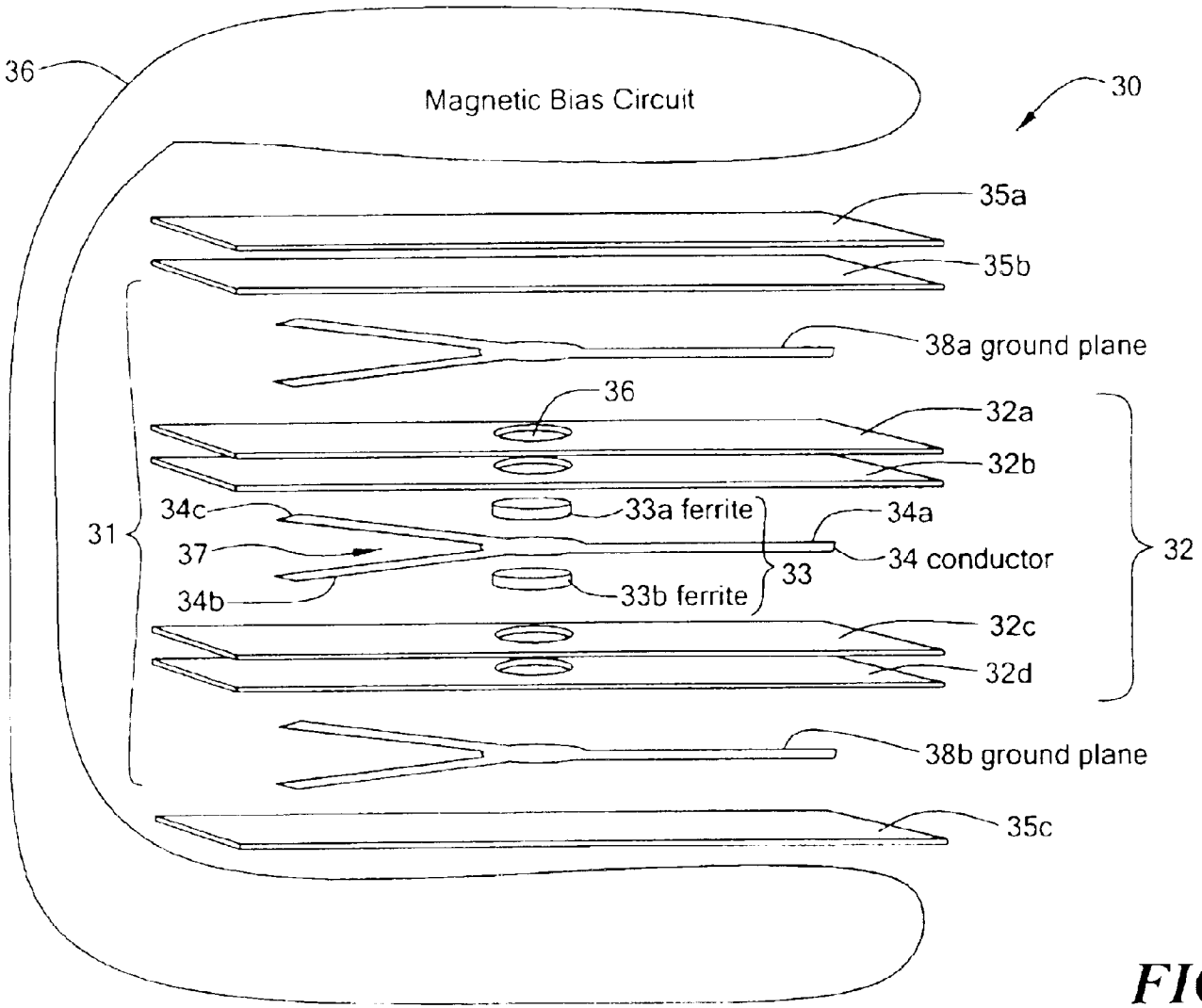
FIG. 2 is an exploded isometric view of an exemplary circulator, a portion of which is shown in FIG. 1.

Referring now to FIG. 2, an exemplary circulator 30 includes a circulator portion 31. The circulator portion 31 includes an LTCC substrate 32 having four layers 32*a*–32*d*. The circulator portion 31 also includes a ferrite structure 33 comprised of two ferrite portions 33*a*, 33*b* and a circulator conductor 34 having transmission lines 34*a*–34*c* and a circulator junction 37. The circulator conductor 34 is disposed between the two ferrite portions 33*a*, 33*b*. The circulator portion 31 also includes two ground planes 38*a*, 38*b* disposed over layers 32*a* and 32*d* respectively. The circulator conductor transmission lines 34*a*–34*c* thus correspond to strip transmission lines having desired electrical characteristics.

Some or all of the LTCC layers, here four layers 32*a*–32*d*, have a hole, of which hole 36 is but one example, through which the ferrite portions 33*a*, 33*b* are disposed. The number of LTCC layers having the hole 36 is determined in accordance with the thickness of the LTCC layers 32*a*–32*d* and the thickness of the ferrite portions 33*a*, 33*b*.

In one embodiment, the substrate 32 is provided from four layers of LTCC tape having a thickness of about 0.010 inch pre-fired and about 0.0074 inch post-fired, a relative dielectric constant of about 5.9 and a loss characteristic at 24 GHz of 1.1 dB per inch for a 0.0148 inch ground plane spacing. Those of ordinary skill in the art will appreciate of course that other types of LTCC tape can also be used, having similar mechanical and electrical characteristics. For example, the LTCC layers 32*a*–32*d* could also be provided as A6-M LTCC tape manufactured by Ferro Corporation.

Additional LTCC layers, for example LTCC layers 35*a*–35*c*, are disposed about the circulator portion 31 to provided additional mechanical strength and/or additional layers for circuit interconnections. It will, however, be recognized that LTCC layers 35*a*–35*c* are not required elements for operation of the circulator portion 31. However, in one exemplary embodiment, the ground planes 38*a*, 38*b* are printed or etched upon the LTCC layers 35*b*, 35*c* respectively, using conventional circuit trace methods.

It should be understood that the various LTCC layers 32*a*–32*d*, 35*a*–35*c*, here shown as an exploded view, can be mechanically coupled together with adhesive or the like to form an LTCC multi-layered structure. Some or all of the LTCC layers 32*a*–32*d*, 35*a*–35*c* can also have a variety of conductive circuit traces, a variety of circuit elements, and/or a variety vias disposed thereon so as to form a multi-layer circuit structure to which the circulator portion 31 can be coupled.

The circulator portion 31 and additional LTCC layers 35*a*–35*c* are disposed within a magnetic bias circuit 36 that provides a DC magnetic flux in the vicinity of the ferrite structure 33.

The LTCC layers 32*a*–32*d*, 35*a*–35*c* are provided from LTCC material for a variety of reasons, including but not limited to its potential for low cost in high volume production. Furthermore, LTCC allows compact circuit design and is compatible technology at radio frequency (RF) signal frequencies, including microwave signal frequencies. LTCC can also be provided as layers having integral circuit traces and large quantities of reliable, embedded vias. A variety of electronic devices, for example surface mount devices, can also be integrated with LTCC.

The LTCC circulator portion 31 is described by a variety of design parameters as listed below. In the exemplary embodiment of FIG. 2, the dielectric constant of the ferrite portions 33*a*, 33*b* is 12.9, the dielectric constant of the LTCC layers 32*a*–32*d*, 35*a*–35*c* is 5.9, the thickness of each ferrite portion 33*a*, 33*b* is 0.0148 inches, the radius, R, of each ferrite portion 33*a*, 33*b* is 0.040 inches, the radius, r, of the circulator junction is 0.040 inches (to be further described in FIG. 4), the saturation flux density of the ferrite portions 33*a*, 33*b* is 3150 Gauss, the magnetic flux density of the magnetic bias circuit 36 is 4700 Oersteds, the loaded Q is 0.979, the operating frequency is 25 GHz, the resonator conductance is 0.065, the thickness, t, of the transmission lines 18*a*–18*c* is 0.0004 inches, the width, w, of the transmission lines 18*a*–18*c* is 0.016 inches, the spacing between the ground planes 38*a*, 38*b* is 0.0296 inches, the dielectric intrinsic impedance is 156 ohms, the junctions intrinsic impedance of the ports 14*a*–14*c* is 70 ohms, the ferrite anisotropic splitting ratio is 0.725 (to be further described in FIGS. 6 and 7), the coupling angle is 0.2 radians (to be further described in FIG. 4), and, as mentioned above, the thickness of the LTCC layers 34*a*–34*d*, 35*a*–35*c* is 0.0074 inches.

Figure 3:
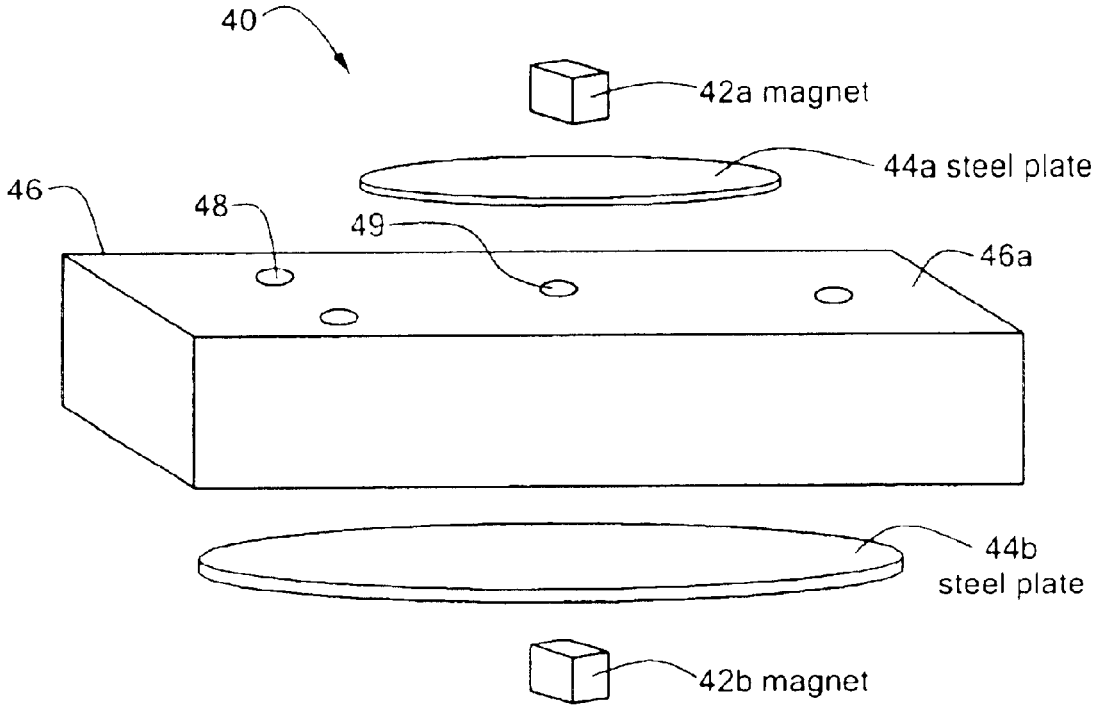
FIG. 3 is an isometric view of the circulator of FIG. 2

Referring now to FIG. 3, an exemplary LTCC circulator 40, which may be comprised of circulator portions 10 and 31 described above in conjunction with FIGS. 1 and 2, also includes an upper magnet 42*a*, an upper steel plate 44*a*, a lower steel plate 44*b*, and a lower magnet 42*a*, surrounding the LTCC substrate 46, and in combination corresponding to the magnetic bias circuit 36 of FIG. 2. The LTCC substrate 46 can, for example, be the LTCC substrate 32*a*–32*d*, 35*a*–35*c* described in FIG. 2. It should be recognized that the ground planes, e.g. ground planes 38*a*, 38*b* of FIG. 2, the ferrite structure, e.g. the ferrite structure 33 of FIG. 2, and the circulator conductor, e.g. the circulator conductor 34 of FIG. 2, are disposed within the LTCC substrate 46. The LTCC substrate 46 can have electrical vias as described above, of which electrical via 48 is but one example.

One of ordinary skill in the art will recognize the relationship between the magnetic flux density created by the magnets 42*a*, 42*b* at the ferrite structure, e.g. at the ferrite structure 33 of FIG. 2, and the LTCC circulator performance. The magnetic flux density that appears at the ferrite structure can be controlled in part by the upper and lower steel plates 44*a*, 44*b*. The upper and lower steel plates 44*a*, 44*b* can provide a spreading and shape control of the magnetic flux density. The spreading and shape control are related to several factors, including but not limited to, the size, thickness, shape, magnetic permeability of the steel plates 44*a*, 44*b*, and the steel alloy from which the steel plates 44*a*, 44*b* are constructed.

While steel plates 44*a*, 44*b* are shown, it will be recognized that any magnetically responsive material can be used in place of steel.

The LTCC substrate 46 can also have magnetic vias, of which magnetic via 49 is but one example. The placement, quantity, and size of the magnetic vias 49 can provide further control of the magnetic flux density at the ferrite structure, e.g. the ferrite structure 33 of FIG. 2, within the LTCC substrate 46, and can generally provide a higher magnetic flux density than would be available without the magnetic vias 49. The magnetic vias are comprised of any magnetizable material that can alter the magnetic flux in the vicinity of the ferrite structure 33. In one embodiment, the magnetic vias are solid cylinders, each 0.100 inches in diameter, and each having a length that passes through all of the LTCC substrate 46, each having an axis perpendicular to a surface 46*a* of the LTCC substrate 46.

While permanent magnets 42*a*, 42*b* are shown, it will be recognized that a magnetic flux can be provided in a variety of ways, including with electromagnets. In an alternate embodiment, a magnetic ferrite structure, for example the ferrite structure 33 of FIG. 2, provides the magnetic flux. It will further be recognized that this invention can provide a variety of magnetic via quantities and sizes can be provided with this invention.

Figure 4:
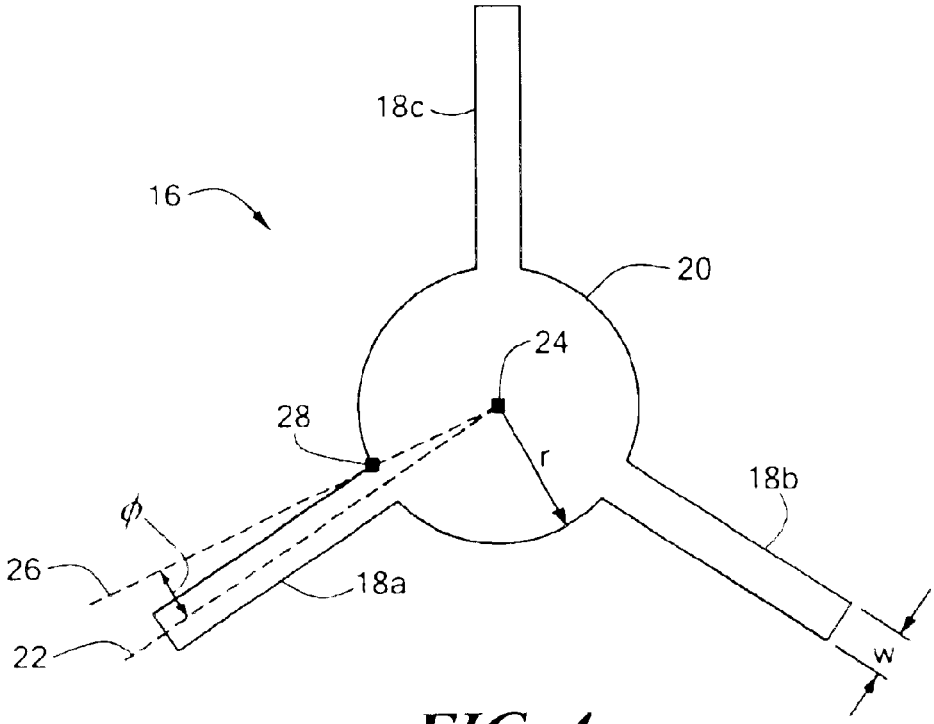
FIG. 4 is a plan view of a circulator conductor forming part of the circulator of FIG. 2.

Referring now to FIG. 4, in which like elements of FIG. 1 are provided having like reference designations, the circulator conductor 16 includes the three transmission lines 18*a*–18*c*, coupled to a circulator junction 20. Each transmission line 18*a*–18*c* has the width, w, and the thickness, t (FIG. 1A).

The circulator junction 20 can have a generally circular shape with a radius, r. A coupling angle, further described below in association with FIGS. 6 and 7, corresponds to an angle, $\phi$. The angle, $\phi$, is the angle between a first line 22 and a second line 26. The first line passes along a centerline of a transmission line, for example centerline 22 along transmission line 18*a*, and intersects a first point 24 at the center of the circulator junction 20. The second line 26 passes through a second point 28 and the first point 24, where the second point 28 is at the intersecting corner of the transmission line, for example transmission line 18*a*, and the circulator junction 20.

While transmission lines 18*a*–18*c* are shown having uniform width, w, in an alternate embodiment, the width, w, can be a stepped width, or a tapered width (not shown). It will be recognized that the steps or the taper are selected in accordance with a desired impedance match between the transmission lines 18*a*–18*c* and the circulator junction 20.

The circulator conductor 16 can be formed as a single piece of conductive material, for example copper. Alternatively, the circulator conductor 16 or a portion of the circulator conductor can be provided on the LTCC substrate using either an additive process (e.g. sputtering) or a subtractive process (e.g. etching). It one exemplary embodiment the radius, r, of the circulator junction 20 is equal to the ferrite structure radius, R, of FIG. 1B. In another exemplary embodiment, the radius, r, and the radius, R, are not equal.

Figure 5:
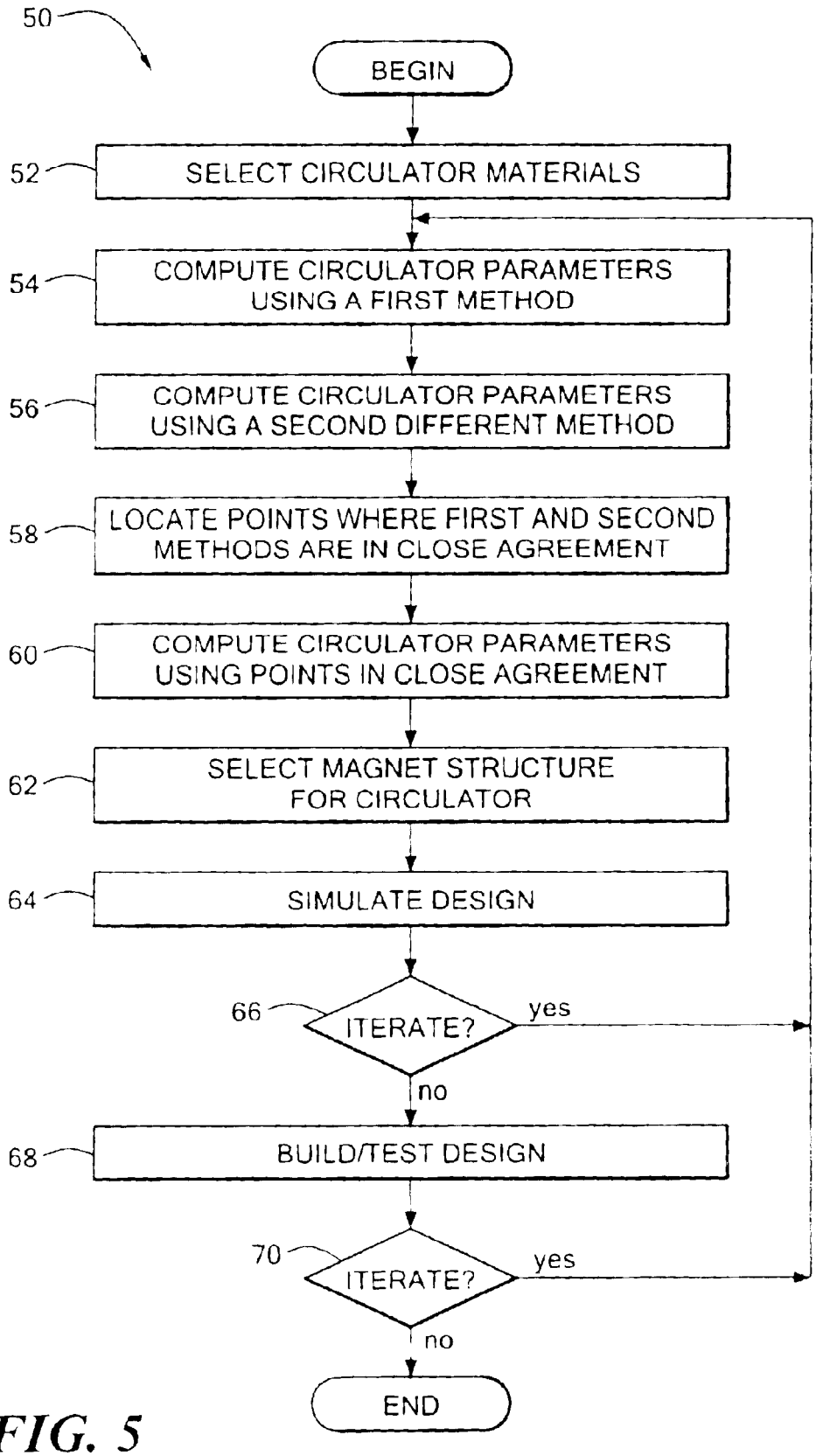
FIG. 5 is flow diagram of an exemplary technique for designing a circulator in accordance with the present invention.

Referring now to FIG. 5, a technique 50 for designing the LTCC circulator begins at step 52 at which the designer selects the type of materials to be used. Here, the designer selects the LTCC material as the substrate material, e.g. the substrate 32 of FIG. 2. The ferrite material, e.g. the material of the ferrite structure 33 of FIG. 2, is selected in accordance with a variety of factors, including but not limited to, the ferrite electrical performance at the desired signal frequency of operation, the thermal expansion characteristics of the ferrite material relative to the LTCC material, and the dielectric constant of the ferrite material relative to the LTCC material. In one exemplary example, the ferrite material is selected as TT1-3000 from the TransTech Corporation. It will, however, be recognized that other ferrite materials having similar electrical and mechanical characteristics can also be used.

At step 54, the designer determines circulator design parameters by a first design method. For example, a conventional Fay-Comstock design method can be used. Design parameters were previously described in association with FIG. 2. The circulator design parameters will be further described in association with FIGS. 6 and 7. At step 56, the designer determines the circulator design parameters by a second design method. For example, a conventional Wu/Rosenbaum design method can be used. At step 58, the designer compares the design parameters generated by the first and the second design methods to determine design points where the design parameters predicted by the two design methods match or nearly match. At step 60, the designer computes final circulator design parameters that correspond to the first and second design methods.

At step 62, the designer selects magnets, e.g. magnets 42*a*, 42*b* of FIG. 3 that can provide the desired magnetic flux density. The desired magnetic flux density is selected in accordance with the ferrite material selected at step 52. As is known, ferrite material saturates magnetically above a flux density specific to the particular ferrite material. It is desirable to keep the magnetic material at a magnetic flux density below that which will saturate the ferrite material. It is further desirable to provide a uniform magnetic field throughout the volume of the ferrite structure. Thus, magnetic field spreaders, for example the steel plates 44*a*, 44*b* of FIG. 3 can also be selected at step 62, as well as magnetic vias, for example, the magnetic via 49 of FIG. 3.

At step 64, the designer simulates the resulting design to provide simulated circulator performance results. The simulation will be described in more detail in association with FIG. 5A. The simulated performance results include, but are not limited to, a simulated resulting magnetic field at the ferrite structure, a simulated insertion loss generated by the circulator, and a simulated isolation generated by the circulator.

At step 66, the designer inspects the simulated performance results. If the simulated performance results are acceptable, the process continues to step 68. If the design does not provide the desired simulated performance results, the designer can go back to any earlier step, and in particular to step 54. Repeating step 54 and subsequent steps, the designer selects new circulator parameters.

At step 68, the designer builds and tests the circulator to determine circulator actual performance results. The actual performance results include actual insertion loss generated by the circulator, and actual isolation generated by the circulator. If the performance results are not optimal, the designer iterates the process beginning again at step 54.

Figure 5A:
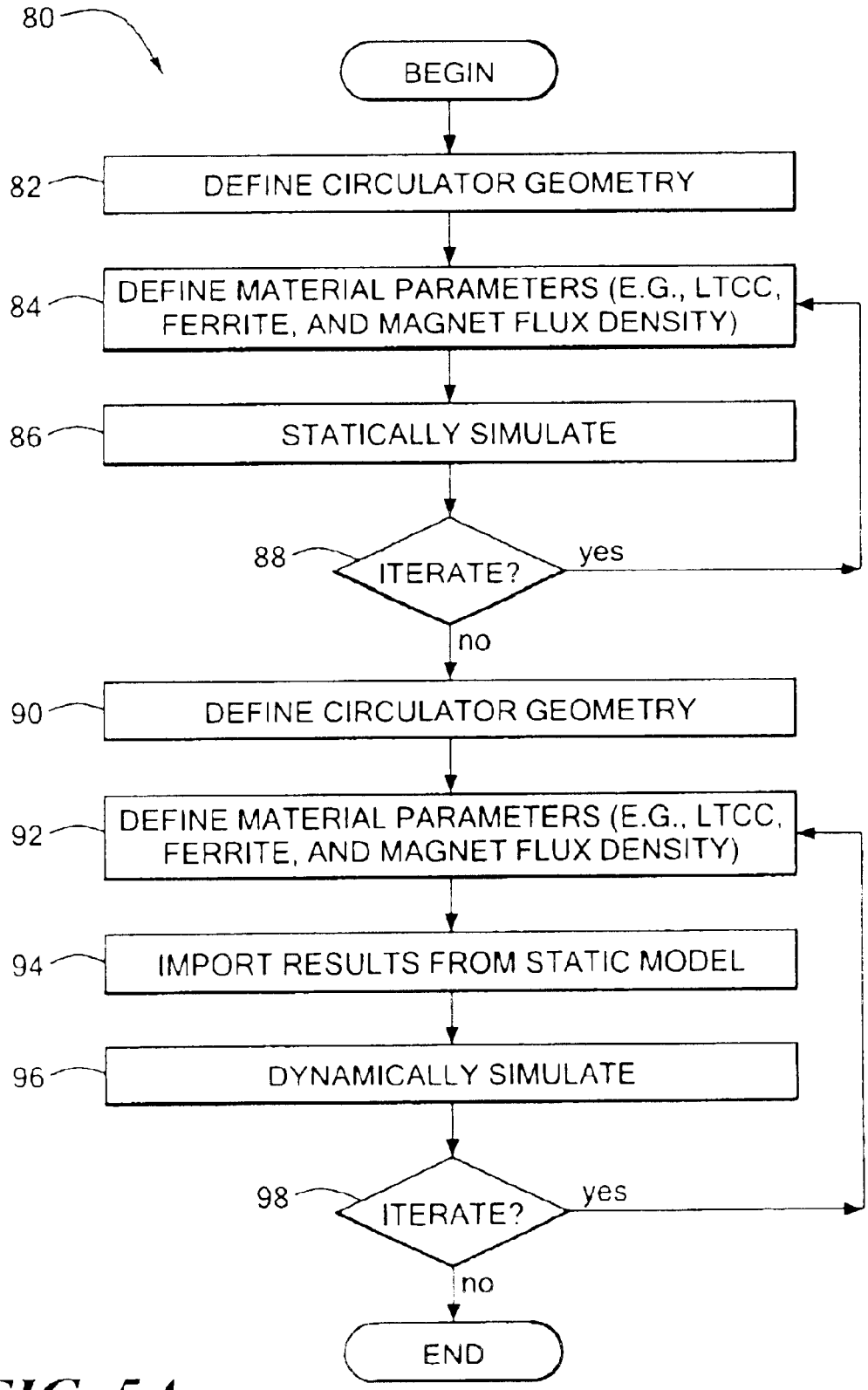
FIG. 5A is a flow diagram showing details corresponding to a portion of the flow diagram of FIG. 5.

Referring now to FIG. 5A, a technique 80 for simulating the performance of the LTCC circulator, the simulation indicated as step 64 of FIG. 5, begins at step 82 at which the designer begins a static magnetic simulation, hereafter a static simulation, by defining the geometry of the circulator. The designer provides circulator geometry as input to a conventional computer program, for example Maxwell®3D from the Ansoft Corporation. At Step 84, the designer defines the circulator materials by way of a variety of material parameters. The material parameters include, but are not limited to an LTCC magnetic permeability, a ferrite magnetic permeability, a magnetic field spreader magnetic permeability, and a magnetic field strength provided by the permanent magnets.

At step 86, the designer statically simulates the circulator to determine the expected magnetic field generated at the ferrite structure (e.g., 33*a*, 33*b*, FIG. 2) by the selected magnets (e.g., 42*a*, 42*b*, FIG. 3) and the selected magnetic field spreader (e.g., 44*a*, 44*b*, FIG. 3). As described above, it is desirable that the generated magnetic field be geometrically uniform throughout the volume of the ferrite structure, and have a flux density that does not saturate the ferrite structure.

At step 88, the designer inspects the static simulation results. If the static simulation results are acceptable, the process continues to step 90. If the design does not provide the desired static simulation results, the designer can go back to any earlier step, and in particular to step 84.

At step 90, the designer begins a dynamic electromagnetic simulation, hereafter a dynamic simulation, for which the designer again defines the geometry of the circulator. The circulator geometry can be provided as input to a conventional computer program, for example HFSS™ from the Ansoft Corporation.

At Step 92, the designer defines the circulator materials by way of a variety of material parameters. The material parameters can include, but are not limited to the LTCC magnetic permeability, the ferrite magnetic permeability, an LTCC dielectric constant, and a ferrite dielectric constant.

At step 94, magnetic field data provided by the static magnetic simulation at step 86 are imported to the dynamic simulation. At step 96, the designer dynamically simulates the circulator to determine the simulated circulator performance. As described above, the simulated performance can include, but are not limited to, the simulated isolation and the simulated insertion loss.

At step 98, the designer inspects the dynamic simulation results. If the simulation results are acceptable, the simulations are complete. If the design does not provide the desired simulation results, the designer can go back to any earlier step, and in particular to step 92.

Figure 6:
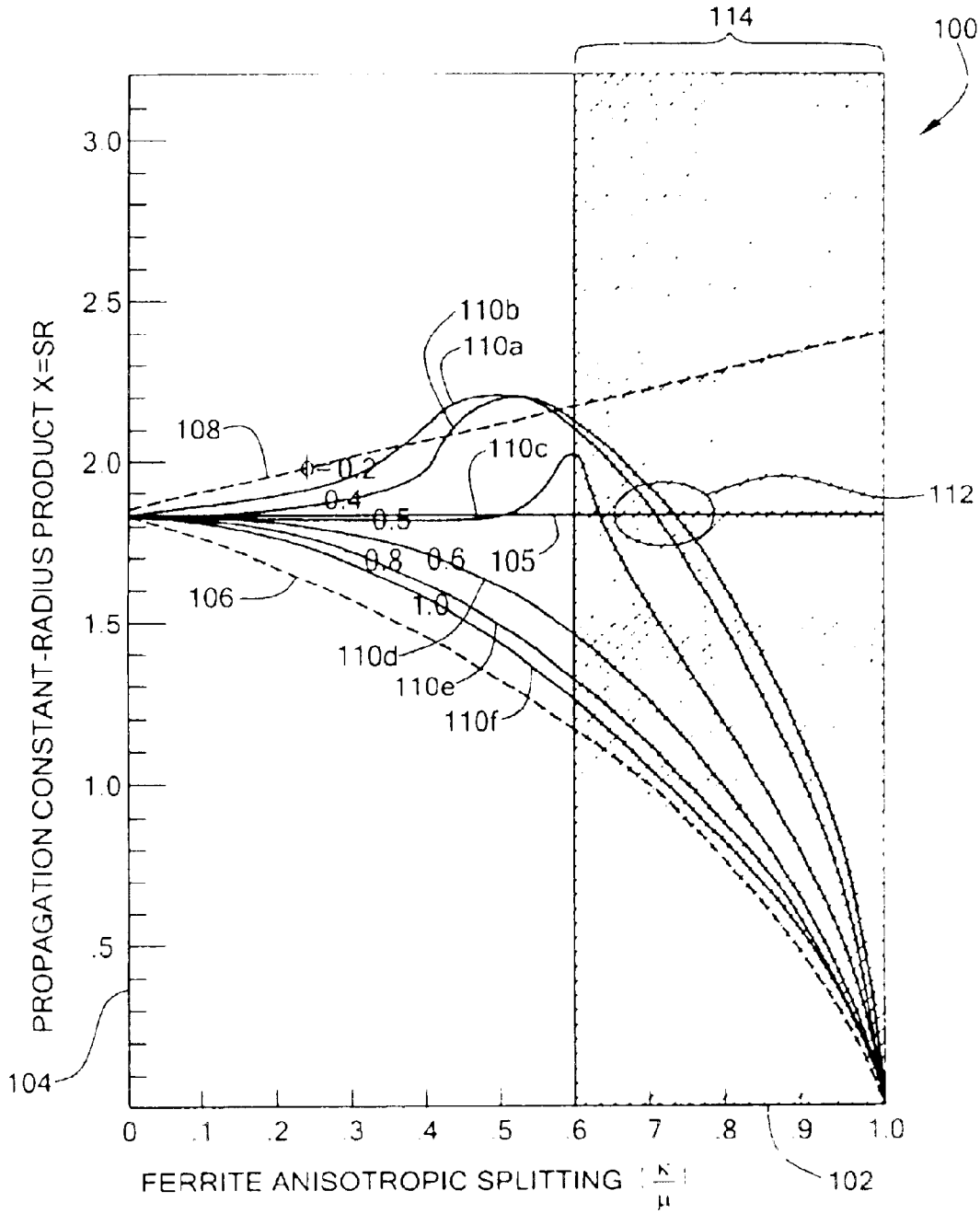
FIG. 6 is a plot of ferrite anisotropic splitting vs. a propagation constant-radius product.

Referring now to FIG. 6, a graph 100 is shown having a horizontal axis 102 with a scale corresponding to a ferrite anisotropic splitting factor. A vertical axis 104 corresponds to a propagation constant-radius product.

Results from two conventional calculation methods are shown. A first curve 105 shows a relationship between the propagation constant-radius product and the ferrite anisotropic splitting factor as predicted by the conventional Fay-Comstock method. A group of curves 110*a*–110*f* show the relationship predicted by the conventional Wu/Rosenbaun method. Each of the curves 110*a*–110*f* corresponds to a particular coupling angle, $\phi$, indicated as values 0.2, 0.4, 0.5, 0.6, 0.8, and 1.0 radians on each respective curve 110*a*–110*f* and as described above in association with FIG. 4. Curves 106, 108 represent the lower and upper bounds respectively of the predictions based upon the Wu/Rosenbaum method.

In accordance with the present invention, both prediction methods are used. A region 114 having a ferrite anisotropic splitting ratio greater of greater than 0.6 is an optimum region as is described in FIG. 7 below. Within the region 114 and in particular within a region 112, the two prediction methods yield equivalent results. Curves 110*b*, 110*c* and 105 intersect within the region 112. Thus, the designer uses the results within the region 112 to provide the circulator parameters for a ferrite structure (e.g., 33, FIG. 2) having the propagation constant-radius product and the ferrite anisotropic splitting factor as indicated.

The circulator parameters that are associated with the region 112 include the dielectric constant of ferrite, the dielectric constant of the LTCC substrate, e.g. substrate 32 of FIG. 2, the operating frequency, the saturation magnetization of the ferrite structure, e.g. the ferrite structure 33 of FIG. 2, the DC magnetic field strength of the magnetic bias circuit, e.g. the magnetic bias circuit 36 of FIG. 2, the junction impedance, the dielectric intrinsic impedance, the coupling angle, e.g. the coupling angle (p of FIG. 4, the resonator conductance, the loaded Q, the resonator conductance, the thickness of the ferrite structure, e.g. the ferrite structure 33 of FIG. 2, and the spacing of the ground planes, e.g. the ground planes 38*a*, 38*b* of FIG. 2. Exemplary values are given in association with FIG. 2.

Figure 7:
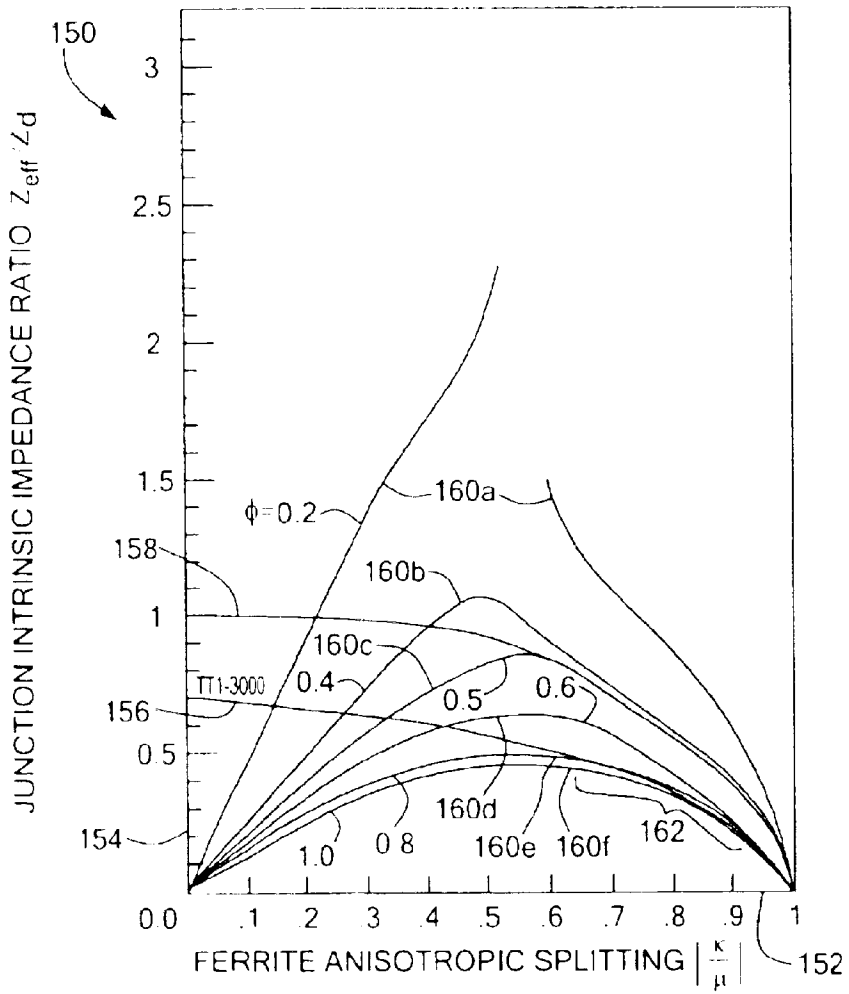
FIG. 7 is a plot of ferrite anisotropic splitting vs. junction intrinsic impedance ratio.

Referring now to FIG. 7, a graph 150 is shown having a horizontal axis 152 with a scale corresponding to the ferrite anisotropic splitting factor. A vertical axis 154 corresponds to a junction intrinsic impedance ratio. Curve 156 represents predicted performance data that results from using a LTCC substrate or similar substance having a realizable dielectric constant of approximately 5.9. Curves 160*a*–160*f* represent calculated data associated with ideal circulators that have desired operational characteristics. Each of the curves 160*a*–160*f* corresponds to a particular coupling angle, $\phi$, indicated as values 0.2, 0.4, 0.5, 0.6, 0.8, and 1.0 radians on each respective curve 160*a*–160*f* and as described above in association with FIG. 3. Curve 158 represents data that results from using an LTCC substrate or similar substance having an unrealizable high dielectric constant that matches that of the ferrite, or approximately 12.9.

Importantly, for a ferrite anisotropic splitting ratio of greater than 0.6, corresponding to region 162, curve 156 for a realizable LTCC substrate intersects ideal curves 160*e* and 160*f*. Thus, circulators that have the design parameters associated with region 162 are optimal. A ferrite anisotropic splitting factor of greater than 0.6 is preferred and is selected above in association with FIG. 6.

The circulator parameters that are associated with the region 162 include the dielectric constant of the ferrite structure, e.g. the ferrite structure 33 of FIG. 2, the dielectric constant of the LTCC substrate, e.g. the LTCC substrate 32 of FIG. 2, the operating frequency, the saturation magnetization of ferrite structure, e.g. the ferrite structure 33 of FIG. 2, and the DC magnetic field strength of the magnetic bias circuit, e.g. the magnetic bias circuit 36 of FIG. 2.

Figure 8:
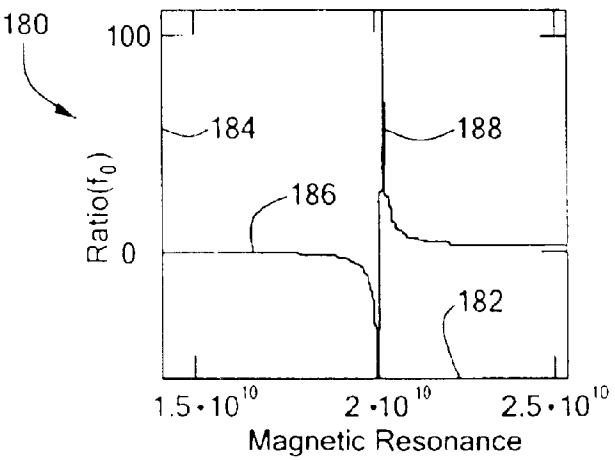
FIG. 8 is a plot of properties associated with each permanent magnet used in the circulator of FIG. 2.

Referring now to FIG. 8, a graph 180 includes a horizontal scale 182 in Hertz or $f_0$, where $f_0$ is equal to the product of Gauss and Hertz per Oersted. The graph 180 also includes a vertical scale 184 in non-dimensional units corresponding to the anisotropic splitting factor, where the anisotropic splitting factor is a function of $f_0$. A curve 186 shows the relationship between the anisotropic splitting factor and $f_0$. The curve 186 has a resonance 188 at $f_0$ of approximately $2\times10^{10}$ Hertz. Thus, at a particular magnetic field strength corresponding to resonance 188, the anisotropic splitting ratio is unstable. It will be recognized that in order to obtain the most repeatable magnetic field, a magnetic flux (Gauss) should be used such that $f_0$ is below the resonance of 188.

Figure 8A:
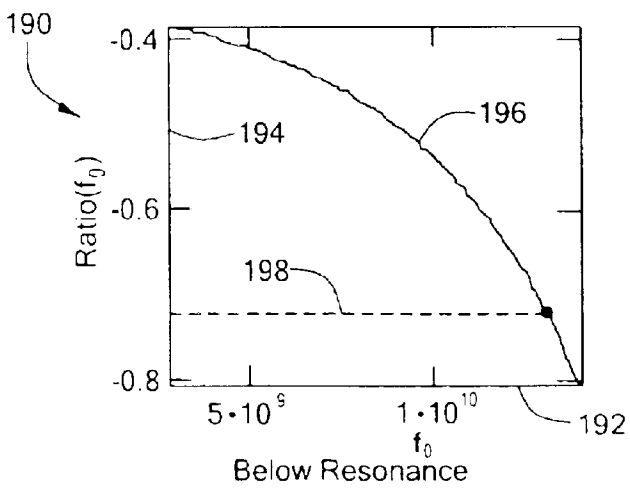
FIG. 8A is another plot of properties associated with each permanent magnet used in the circulator of FIG. 2.

Referring now to FIG. 8A, a graph 190 includes a horizontal scale 192 in Hertz or $f_0$, $f_0$ equal to the product of Gauss and Hertz per Oersted. Here, the horizontal scale has been expanded as compared to the horizontal scale 182 of FIG. 8. The graph 190 also includes a vertical scale 194 in the non-dimensional units corresponding to the anisotropic splitting factor. A curve 196 shows the relationship between the anisotropic splitting factor and $f_0$. A line 198 is drawn at an anisotropic splitting factor of −0.725. The intersection of the line 198 and the curve 196 occurs at $f_0$ equal to $1.31\times10^{10}$.

As described above, $f_0$ is defined as Gauss times Hertz per Oersted. In one particular embodiment, the magnet is selected to provide 4695 Gauss and $2.8\times10^6$ Hertz per Oersted at the ferrite structure, these values yielding the $f_0$ equal to $1.31\times10^{10}$.

The graphs 180, 190 of FIGS. 8 and 8A allow the designer to select a magnetic flux that is both below that which would saturate the ferrite structure, for example the ferrite structure 33 of FIG. 2, and that also allows the anisotropic splitting ratio to be kept away from resonance, for example the resonance 188.

Having described the preferred embodiments of the invention, it will now become apparent to one of ordinary skill in the art that other embodiments incorporating their concepts may be used. It is felt therefore that these embodiments should not be limited to disclosed embodiments but rather should be limited only by the spirit and scope of the appended claims.

All publications and references cited herein are expressly incorporated herein by reference in their entirety.

What is claimed is:

1. A circulator having a first port, a second port and a third port, comprising:

a low temperature co-fired ceramic (LTCC) substrate having first and second opposing surfaces; and a ferrite disk having first and second opposing surfaces, said ferrite disk disposed between the first and the second opposing surfaces of said LTCC substrate, wherein the first and second opposing surfaces of said LTCC substrate cover said ferrite disk such that the ferrite disk is embedded in the LTCC substrate.

2. The circulator of claim 1, further comprising:

a first ground plane disposed about the first surface of said ferrite disk;

a second ground plane disposed about the second surface of said ferrite disk; and a circulator conductor having at least a portion thereof disposed within said ferrite disk.

3. The circulator of claim 2, wherein said circulator conductor comprises:

a conductor junction having a radius, the conductor junction bisecting said ferrite disk and parallel to the first and second ferrite disk opposing surfaces, The conductor junction having the first port, the second port and the third port;

a first transmission line disposed in said LTCC substrate and coupled to the first port of the circulator;

a second transmission line disposed in said LTCC substrate and coupled to the second port of the circulator; and a third transmission line disposed in said LTCC substrate and coupled to the third port of the circulator, each of the first, second, and third transmission lines having a length, one or more widths, a height and said first and second ground planes having a ground plane separation, each selected to provide the first, second, and third transmission lines with a predetermined impedance characteristic.

4. The circulator of claim 3, wherein the first, second and third transmission lines have a stepped width.

5. The circulator of claim 3, wherein the first, second and third transmission lines have a tapered width.

6. The circulator of claim 3, wherein said circulator conductor is disposed such that in response to a radio frequency signal propagating along said circulator conductor, an electric field is established between said circulator conductor and said first and second ground planes, the electric field passing through said ferrite disk.

7. The circulator of claim 1, wherein said ferrite disk comprises a first ferrite disk having the first ferrite disk opposing surface, the first ferrite disk disposed proximate to and parallel to a second ferrite disk having the second ferrite disk opposing surface, the conductor junction disposed between the first and the second ferrite disks.

8. The circulator of claim 1, further comprising:

a direct current (DC) magnetic field bias circuit disposed proximate said LTCC substrate.

9. The circulator of claim 8, wherein said direct current (DC) magnetic field bias circuit is disposed to generate a DC magnetic field passing through said ferrite disk.

10. The circulator of claim 8, wherein said ferrite disk has a saturation magnetization selected in accordance with a strength of a magnetic field provided by said direct current (DC) magnetic field bias circuit.

11. The circulator of claim 8, wherein said direct current (DC) magnetic field bias circuit comprises:

a first permanent magnet disposed proximate the first opposing surface of said LTCC substrate; and a second permanent magnet disposed proximate the second opposing surface of said LTCC substrate.

12. The circulator of claim 11, further including:

a magnetic field spreader disposed proximate said substrate.

13. The circulator of claim 12, wherein the magnetic field spreader comprises:

a first magnetically responsive plate disposed between the first permanent magnet and the first surface of said LTCC substrate; and a second magnetically responsive plate disposed between the second permanent magnet and the second surface said LTCC substrate.

14. The circulator of claim 11 further including:

one or more magnetic vias disposed in said LTCC substrate.

15. The circulator of claim 8, wherein the direct current (DC) magnetic field bias circuit includes said ferrite disk having a permanent magnetic field.

16. The circulator of claim 15, further including:

a magnetic field spreader disposed proximate said LTCC substrate.

17. The circulator of claim 16, wherein the magnetic field spreader comprises:

a first magnetically responsive plate disposed proximate the first surface of said LTCC substrate; and a second magnetically responsive plate disposed proximate the second surface of said LTCC substrate.

18. The circulator of claim 1, wherein said ferrite disk is provided as one of: (a) a monolithic ferrite disk; and (b) a plurality of physically separate ferrite disks.

19. The circulator of claim 1, wherein said ferrite disk has a coefficient of thermal expansion selected in accordance with the coefficient of thermal expansion of said LTCC substrate.

20. The circulator of claim 1, wherein said LTCC substrate is comprised from a plurality of physically separate LTCC layers.

21. The circulator of claim 20, wherein the plurality of LTCC layers are bonded.

22. The circulator of claim 20, wherein at least one of the plurality of LTCC layers has a conductive trace disposed thereon.

23. The circulator of claim 20, wherein at least one of said first ground plane, said second ground plane and a portion of said circulator conductor is disposed on a respective one of the plurality of LTCC layers.

24. The circulator of claim 1, wherein said ferrite disk has a radius of about 0.040 inches and a thickness of about 0.296 inches.

25. The circulator of claim 1, wherein said ferrite disk has a dielectric constant selected in accordance with the dielectric constant of said LTCC substrate.

26. A circuit board, comprising:

a low temperature co-fired ceramic (LTCC) substrate having first and second opposing surfaces, the LTCC substrate having a plurality of LTCC layers, at least one of the LTCC layers having a substrate hole disposed therein; and a circulator having a ferrite disk, the ferrite disk disposed between the first and the second opposing surfaces of said LTCC substrate, said ferrite disk disposed in the substrate hole., wherein the first and second opposing surfaces of said LTCC substrate cover said ferrite disk such that the ferrite disk is embedded in the LTCC substrate.

27. A circulator having a first port, a second port, and a third port, comprising:

a low temperature co-fired ceramic (LTCC) substrate having first and second opposing surfaces;

a ferrite disk having, first and second opposing surfaces, said ferrite disk disposed between the first and the second opposing surfaces of said LTCC substrate;

a direct current (DC) magnetic field bias circuit disposed proximate said LTCC substrate, wherein said direct current (DC) magnetic fluid bias circuit includes said ferrite disk having a permanent magnetic field; and a magnetic field spreader disposed proximate said substrate, wherein the magnetic field spreader comprises:

a first magnetically responsive plate disposed within said LTCC substrate, between the first surface of said LTCC substrate and the first surface of said ferrite disk; and a second magnetically responsive plate disposed within said LTCC substrate, between the second surface of said LTCC substrate and the second surface of said ferrite disk.

28. The circulator of claim 27, further including:

one or more magnetic vias disposed in said LTCC substrate.

29. A circulator having a first port, a second port, and a third port, comprising:

a low temperature co-fired ceramic (LTCC) substrate having first and second opposing surfaces;

a ferrite disk having first and second opposing surfaces, said ferrite disk disposed between the first and the second opposing surfaces of said LTCC substrate;

a direct current (DC) magnetic field bias circuit disposed proximate said LTCC substrate, wherein said direct current (DC) magnetic field bias circuit comprises:

a first permanent magnet disposed proximate the first opposing surface of said LTCC substrate; and a second permanent magnet disposed proximate the second opposing surface of sad LTCC substrate; and a magnetic field spreader disposed proximate said substrate, wherein the magnetic field spreader comprises:

a first magnetically responsive plate disposed within said LTCC substrate, between the first surface of said LTCC substrate and the first surface of said ferrite disk; and a second magnetically responsive plate disposed within said LTCC substrate, between the second surface of said LTCC substrate and the second surface of said ferrite disk.

30. The circulator of claim 29, further including:

one or more magnetic vias disposed in said LTCC substrate.

* * * * *

UNITED STATES PATENT AND TRADEMARK OFFICE

CERTIFICATE OF CORRECTION

PATENT NO. : 6,844,789 B2
DATED : January 18, 2005
INVENTOR(S) : Lombardi et al.

It is certified that error appears in the above-identified patent and that said Letters Patent is hereby corrected as shown below:

Column 3,
Line 30, delete "provided additional" and replace with -- provide additional --.
Line 43, delete "variety vias" and replace with -- variety of vias --.

Column 4,
Line 50, delete "magnetic vias 49" and replace with -- magnetic vias --.
Lines 54-55, delete "magnetic vias 49." and replace with -- magnetic vias. --.

Column 5,
Line 33, delete "It one exemplary embodiment" and replace with -- In one exemplary embodiment, --.

Column 7,
Line 56, delete "angle (p" and replace with -- angle φ --.

Column 9,
Lines 27-28, delete "The conductor" and replace with -- the conductor --.

Column 10,
Line 19, delete "said LTCC substrate." and replace with -- of said LTCC substrate --.

Column 11,
Line 4, delete "hole., wherein" and replace with -- hole, wherein --.

Column 12,
Line 16, delete "of sad LTCC" and replace with -- of said LTCC --.

Signed and Sealed this

Twelfth Day of July, 2005

JON W. DUDAS
*Director of the United States Patent and Trademark Office*